US008322824B2

(12) United States Patent
Peleg et al.

(10) Patent No.: US 8,322,824 B2
(45) Date of Patent: Dec. 4, 2012

(54) METHOD AND APPARATUS FOR PRINTING FLUID ON A SUBSTRATE

(75) Inventors: Eyal Peleg, Zoran (IL); Benji Ruhm, Tel-Aviv (IL); Thomas M Sabo, San Diego, CA (US); Clayton L Holstun, San Marcos, CA (US); Ronald A Askeland, San Diego, CA (US); Ran Vilk, Qiryat Ono (IL); David Vejtasa, Rancho Bernardo, CA (US); Omer Markovsky, Nez-Ziona (IL)

(73) Assignee: Hewlett-Packard Development Company, L. P., Houston, TX (US)

( * ) Notice: Subject to any disclaimer, the term of this patent is extended or adjusted under 35 U.S.C. 154(b) by 233 days.

(21) Appl. No.: 12/597,002

(22) PCT Filed: Apr. 30, 2007

(86) PCT No.: PCT/US2007/010429

§ 371 (c)(1),
(2), (4) Date: Apr. 7, 2010

(87) PCT Pub. No.: WO2008/133630

PCT Pub. Date: Nov. 6, 2008

(65) Prior Publication Data

US 2010/0188464 A1 Jul. 29, 2010

(51) Int. Cl.
*B41J 2/04* (2006.01)

(52) U.S. Cl. ..... 347/54

(58) Field of Classification Search ..... 347/54, 347/95, 97, 102
See application file for complete search history.

(56) References Cited

U.S. PATENT DOCUMENTS

| | | | | |
|---|---|---|---|---|
| 4,745,420 | A | 5/1988 | Gerstenmaier | |
| 6,463,674 | B1 | 10/2002 | Meyers et al. | |
| 7,867,548 | B2 * | 1/2011 | Otis et al. | 427/2.1 |
| 2006/0109326 | A1 | 5/2006 | Nakazawa et al. | |
| 2007/0107253 | A1 * | 5/2007 | Nishiura | 34/444 |
| 2007/0200888 | A1 | 8/2007 | Inoue et al. | |

FOREIGN PATENT DOCUMENTS

| | | | |
|---|---|---|---|
| EP | 0538071 | A | 4/1993 |
| EP | 0752497 | A | 1/1997 |
| WO | WO92/02782 | A | 2/1992 |
| WO | WO2006/043269 | A | 4/2006 |
| WO | WO2006/109326 | | 5/2006 |

OTHER PUBLICATIONS

International Search Reprot and the Written Opinion of the International Searching Authority; PCT/US2007/010429; Data of Mailing Aug. 28, 2008.

PCT Search Report and Written Opinion~PCT/US2007/0140429 dated Feb. 2, 2008.

* cited by examiner

*Primary Examiner* — An Do

(57) ABSTRACT

A method and apparatus for printing fluid on a substrate is provided. The method includes providing drops of the fluid on the substrate and spreading the drops of fluid to increase the surface area covered by those drops. The apparatus includes a printer having a print head for printing drops of fluid on the substrate and a spreader for spreading the fluid drops on the substrate.

9 Claims, 3 Drawing Sheets

METHOD AND APPARATUS FOR PRINTING FLUID ON A SUBSTRATE

This invention relates to a method and apparatus for printing, fluid on a substrate.

Embodiments of the invention will now be described, by way of example only, with reference to the accompanying drawings in which:

FIG. 1 schematically shows a printing apparatus according to an embodiment of the invention;

Figure 4:
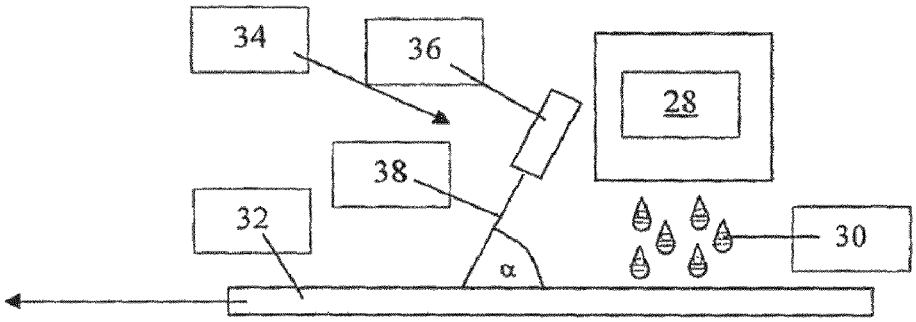
Figure 5:
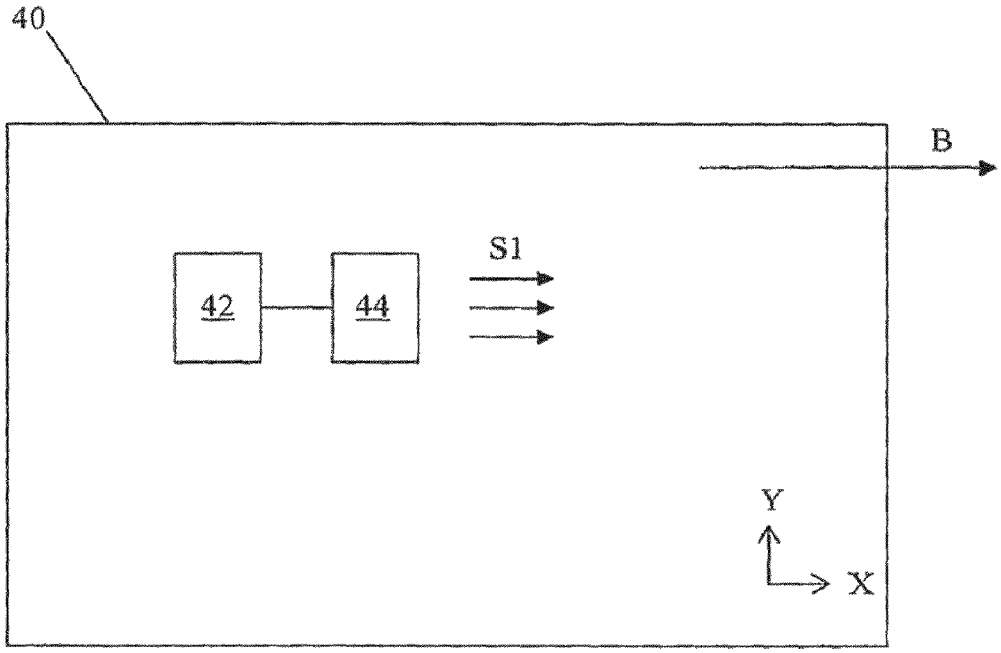
Figure 6:
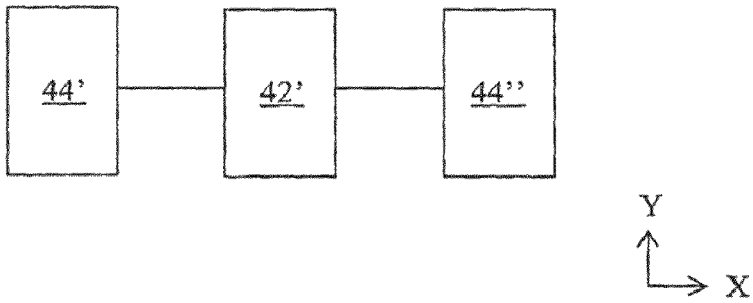
Figure 7:
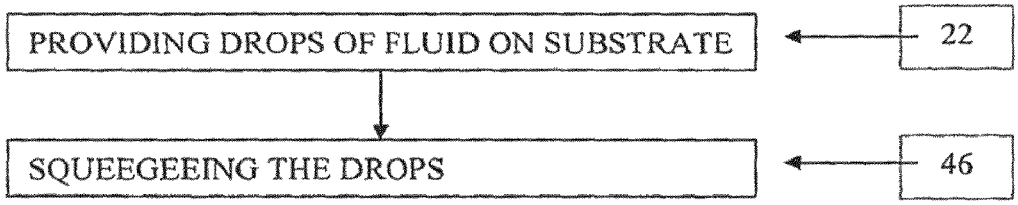
Figure 8:
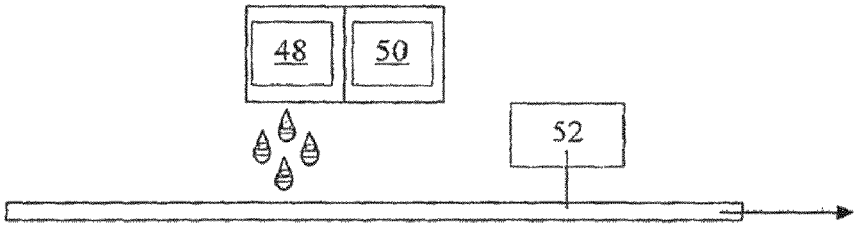

FIG. 4 schematically shows a printing apparatus according to an embodiment of this invention;

FIG. 5 schematically shows a plan view of a printing apparatus according to an embodiment of the invention;

FIG. 6 schematically shows a print head and attached spreaders of a printer according to an embodiment of this invention;

FIG. 7 is a flow chart outlining the method of an embodiment of this invention;

FIG. 8 schematically shows the printing apparatus according to an embodiment of the invention.

Figure 1:
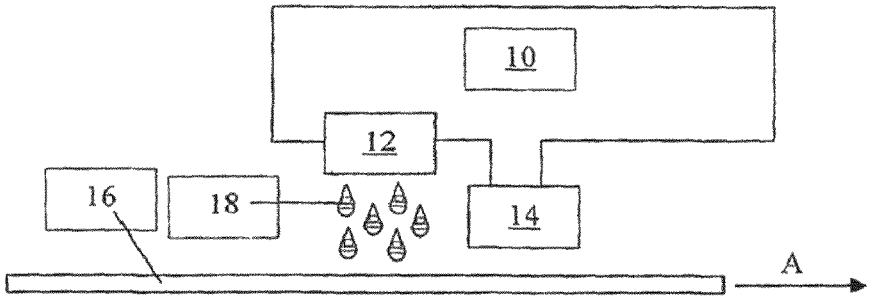

Referring to FIG. 1, a printer 10 includes a print head 12 and a spreader 14. The printer 10 is arranged to print fluid on a substrate 16.

The printer 12 is arranged to print drops 18 of fluid on the substrate 16 in a known manner. In existing printers having such print heads (for example ink jet printers) print quality is a concern and the provision of drops of fluid onto a substrate is carefully carried out in order to achieve consistent drop shape in order to optimise print quality. Drops of fluid on the substrate take a certain amount of time before they are dry. In order to preserve print quality, drying is conventionally achieved by reducing the speed of relative movement between the substrate and the print head, increasing the energy applied to the fluid after it is received on the substrate or increasing the time allowed for drying of the drops of fluid after they are received on the substrate before any further processing of the substrate (e.g. handling of a piece of paper after it has been printed upon).

The spreader 14 is arranged to spread drops 18 of the fluid over a greater area of the substrate 16 than would be normally covered if the spreader was not present (e.g. in a standard inkjet printer).

The spreader 14 is arranged to spread the drops 18 of ink after they have been received on the substrate 16 but before they have completely dried. Advantageously, the required drying time and required energy (e.g. by the application of heat) for drying is reduced by use of the spreader 14. The surface area of substrate 16 covered by a drop 18 is increased by use of the spreader 14 and so more of the fluid comes into to contact with the atmosphere which promotes drying by convection. At the same time, a reduction in the amount of fluid used to cover a particular area of substrate 16 is achieved. Since the drops 18 of fluid are spread before they have been substantially absorbed into the substrate 16, the same number of drops 18 of fluid are able to cover a larger surface area of substrate 16 than previously (without the spreader 14). In some embodiments the spreader 14 allows any active ingredient in the fluid to be generally kept closer to the surface of the substrate 16 without being potentially wasted by being absorbed well beyond the surface of the substrate 16 where it may have less effect. For example in some embodiments an active ingredient in the fluid may be colorant (for example where the fluid is an ink). In other embodiments the fluid may be a primer and the active ingredient may be a chemical which is used to promote adhesion. For some applications it may be desirable to have active ingredients of the fluid only on the surface of the substrate, or at least it may be most efficient to have most of the active ingredients at or as close as possible to the surface of the substrate. The spreader 14 of this invention can help achieve this.

During use of the printer there is relative movement between the print head 12 and the substrate 16. In the embodiment of FIG. 1, arrow A denotes a direction of movement of this substrate 16 relative to the print head 12, which is fixed.

In other embodiments this relative movement may be provided by a fixed substrate over which a moveable print head 12 operates or a system in which both the print head 12 and the substrate 16 move at different velocities.

Figure 2:
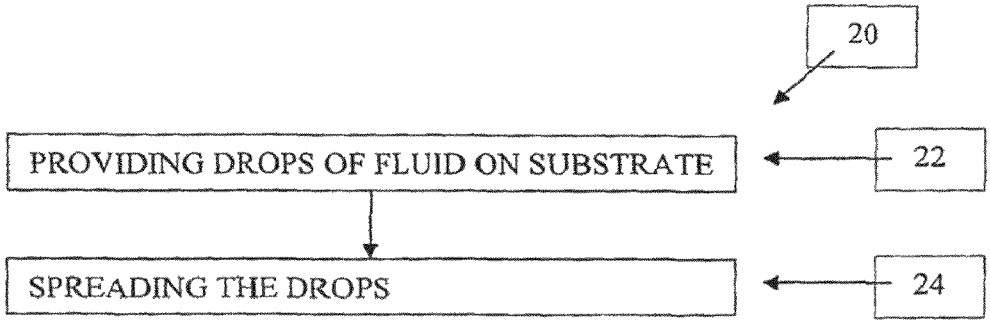
FIG. 2 is a flow chart outlining the method of an embodiment of this invention.

Referring to FIG. 2, according to an embodiment of this invention a method 20 of printing fluid on the substrate 16 comprises providing the drops 18 of fluid on the substrate 16 at an initial step 22. The method 20 comprises a further step 24 of spreading the drops 18 of fluid. This can provide some or all of the advantages mentioned above.

In some embodiments the printer 10 comprises an inkjet printer and the step 22 of providing drops of fluid on the substrate comprises jetting the fluid onto the substrate in a known manner.

In some embodiments the print head 12 and the spreader 14 may be mounted fixed relative to each other on the printer 10. In some embodiments they 12, 14 may be mounted independently of each other and may be moveable independently of each other.

The spreader 14 is required to spread drops 18 of fluid before it is not possible to do so, e.g. before they have dried or become absorbed into the substrate 16. Therefore in some embodiments, the spreader 14 is arranged to spread the drops of fluid immediately after the drops have been placed on the substrate.

The time limit for drying ink on a substrate is dependent upon the composition of the ink and dependent upon the substrate. Therefore in different embodiments, the spreader is arranged to spread the drops within different time limits after it has been placed on the substrate. The spreader must spread the drops before the ink is dry otherwise the ink will not effectively spread. In general, on glossy substrates drops can bead up and drying time can be quite long (in the order of one minute). An example of such a substrate is HP Glossy 100. In other embodiments, for other substrates which are rough and tend to absorb ink, the drying time can be less than one second.

The drying time of an ink can be controlled with the introduction of a surfactant into the ink. For example 1, 2—Hexandiol reduces surface tension in inks.

In one embodiment the squeegee is arranged to spread ink printed by the printing head of an ink jet printer. The substrate upon which the ink is printed moves at about 1 m per second and the squeegee is fixed about 10 cm away from the print head. Therefore the ink is allowed to dry for about 0.1 seconds until it is spread.

The length of time taken for a fluid being applied to a substrate can depend upon many factors, some which are more important than others. For example it can depend upon the fluid composition, the substrate composition, temperature and pressure.

Figure 3:
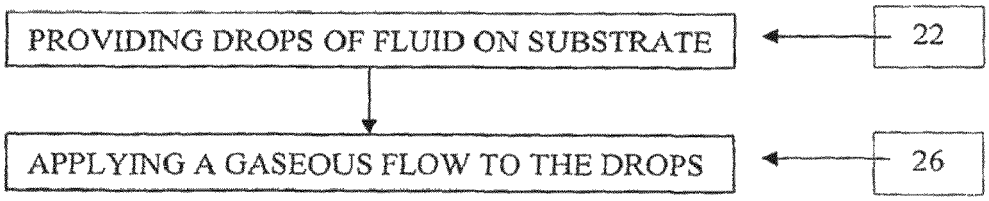
FIG. 3 is a flow chart outlining the method of an embodiment of this invention.

In some embodiments the spreader 14 comprises an air knife and the step 24 of spreading the drops comprises the step 26 of applying a gaseous flow to the fluid drops—this method is represented in the flow chart at FIG. 3.

FIG. 4 schematically shows a system in which a printer having a print head 28 provides fluid drops in the form of ink drops 30 on a moving substrate 32. This printer also includes an air knife 34 in the form of a nozzle 36 which directs a stream 38 of air at the substrate 32. The stream 38 of air hits, the substrate 32 at a position at which there are ink drops 30 which have not totally dried or being totally absorbed into the substrate 32. In this embodiment, the stream 38 is directed onto a portion of the substrate 32 which is as close as possible to the portion at which the ink drops 30 initially contact the substrate 32 without substantially affecting the movement of the ink drops 30 before they land on the substrate 32. This can help to avoid undesirable mixing of different drops before they land on the substrate 32.

In other embodiments the angle of the stream 38 relative to the substrate 32 (which is planar in this embodiment) may vary between 0° and 90°. In this embodiment the angle, α, is fixed. In other embodiments the air knife 34 may be moveable so that the angle α can be adjusted as required (e.g. dependent upon the fluid being used or the substrate being used or the temperature or pressure).

In some embodiments the print head comprises an ink pen having a number of nozzles through which the ink is jetted onto the substrate. The ink pen has a cap, which is required to be replaced over the ink pen in order to avoid ink drying up within the nozzles. The time for which the cap can remain off the pen is known as the "decap" time. The angle of the air knife of this invention may impact upon the decap time since if air is jetted towards the open, decapped ink pen then the ink will dry more quickly in the nozzles and the allowable decap time will be reduced. The skilled person will understand that this should be taken into account when considering the angle at which to set the air knife. For example if a long decap time is essential, then the air knife may be directed away from the ink nozzles to the extent possible.

The decap time is also dependent upon the composition of the ink being used.

A controller may be provided in some embodiments so that the air knife is only switched on when ink is being fired from the nozzles (i.e. when there is no risk of the ink drying). Therefore the ink jetting can be coordinated with the air knife being on to avoid or minimise decapping issues.

In some embodiments other gases may be used. An advantage of using air is that it is cheap and is not flammable or toxic. The air knife applies a force to the ink drop before it has dried in a direction parallel to the direction of the substrate (which is generally planar in this embodiment).

In some embodiments it may be possible to control, the amount of spreading by the specific magnitude and direction of the force applied to the ink drops before they have dried. For example it may be beneficial to apply some force to the ink drop in a direction directly into the substrate (i.e. perpendicular to the plane of the substrate)—this component of applied force may be used to ensure that spreading of the ink drop does not extend beyond certain required boundaries.

In general, the length of the air knife (i.e. the distance between the nozzle and the points at which the stream of air hits the surface) is about 3 mm. The width of the stream of air is between about 0.5 mm and 0.3 mm and the angle, α, is between 45° and 80°. The pressure of the air is about 10 kPa. In other embodiments different values and ranges of values may be used as required.

Referring to FIG. 5, a system according to a further embodiment of the invention is shown in which a substrate 40 is arranged to be printed upon by a print head 42. An air knife 44 is fixed in position relative to the print head 42 in order to spread ink drops originating from the print head 42 after they have landed on the substrate 40. The substrate 40 travels in a direction generally indicated by the arrow B. The stream of air provided by the air knife 44 has a component in the direction of arrow B. Arrows, S1 indicate the direction of spreading of the ink drops due to the air knife 44 as a result of the component of the stream from the air knife in that direction. In this embodiment, the print head moves across the substrate 40 in the X direction (perpendicular to the direction of movement of the substrate, B) only. In other embodiments the substrate maybe fixed and the print head and air knife may move in both the X and Y directions. In such embodiments it is necessary for the relative movement between the print head and the substrate to be such that the stream of air flowing from the air knife contacts the substrate at a particular position after the print head has deposited ink at that particular position. Therefore in the example shown in FIG. 5, if the substrate were fixed and the print head and air knife were to be moveable instead, then the print head would travel in the −X direction while printing, and not in the +X direction. This is because travelling in the +X direction would mean that the air stream from the air knife would pass over a particular point on the substrate before ink has been deposited at that point.

In an alternative embodiment more than one air knife can be provided in order to allow printing in more than one direction. For example FIG. 6 shows a print head 42' with a first air knife 44' and a second air knife 44" on either side of it in the X direction. Such a print head 42' would be able to conveniently print in the +X and the −X direction. As an alternative, the air knife may be moveable so that it is on one side of the print head when printing in a first direction and another side of the print head when printing in a different direction, as required.

Referring to FIG. 7, in a further embodiment the step 24 of spreading the drops comprises the step 46 of squeegeeing the fluid over the substrate. In this embodiment the spreader is a squeegee which is arranged to contact the fluid drops before they have dried and spread them across the substrate.

FIG. 8 shows schematically a print head 48 and a squeegee 50 above a substrate 52. The squeegee 50 is immediately adjacent the print head 48 in order to minimise the time for the fluid to be absorbed into the substrate before being squeegeed.

The squeegee force in this embodiment is kept as low as possible in order to reduce jamming of the substrate in a printer. In some embodiments a plastic squeegee is used. The squeegee has a squeegee blade which, in some embodiments, bends as it is moved across the substrate. The angle of bend of the squeegee blade in some embodiments is between 30° and 45° at its tip. In this embodiment enough force is applied to enable to the squeegee blade to smoothly contour with the substrate as it is moved across it. Commercial presses will require a higher squeegee force than desktop printers due to paper speed and size. Printers which are prone to vibration and rough operating conditions will require higher squeegee forces.

It is known to reduce surface tension in printing fluids by adding surfactants such as 1, 2—Hexandiol. Such surfactants can allow spreading of an ink drop without the squeegee of the present invention. However the squeegee (or air knife) of this invention allows the elimination of such surfactants within inks. The spreading methods of this invention work well with fluids with high surface tension. Therefore the cost of providing surfactants can be avoided with this invention.

The squeegee may be in the form a solid, continuous blade-type wiper which can be made from a metal or from an elastic.

Also alternatively the squeegee maybe in the form of a non-wetting brush to physically spread the liquid. Alternatively the squeegee maybe in the form of a wetting brush that would both physically spread the liquid and capture it in and out of the brush itself so that the fluid is more effectively distributed to dry areas.

If the fluid is electrically charged (such as Electro-ink as used in some HP printers) then the spreader may be in the form of an electrostatic field applier which applies a force to the ink drops before they have dried.

In some embodiments heat can be applied to assist drying further—for example the squeegee may be heated. The embodiments of this invention comprising a squeegee are particularly useful for applying primer to a substrate where accuracy of the placement of the drops of primer is less important than obtaining total coverage of the substrate. Primers are used to make a substrate more receptive to a subsequent ink being deposited.

Although specific embodiments of the invention have been described in relation to ink jet printers it should be appreciated that embodiments of the invention can be realized with other types of printer, e.g. liquid electro photographic printers (e.g. LEP's and LED printers) to name a few.

Also, it should be appreciated that embodiments and aspects of the invention that are defined in a particular category (e.g. a method) can also be defined as other categories (e.g. a printing system or a printer). The skilled person will understand that the features and embodiments of the invention that are described and claimed may be combined in various ways.

In some embodiments the spreading is modelled or predicted beforehand. The amount of spreading may be predicted. The extent of spreading (possibly in one or more directions) may be predicted. The spreading can then be carried out using the models/predictions in order to achieve a desires spreading result. The spreading predictions may be carried out by software running on the processor of the printer, or the spreading predictions may be carried out at a prior stage before instructions are provided to the printer.

In some embodiments, a drying device is provided to dry the fluid after it has been spread. The drying device may be part of the printer. The spreading effect of this invention may provide for a quicker, more efficient drying process via the drying device than if the spreading effect is not present. In printers with existing drying devices, the spreader of this invention may cause the printer to work more efficiently as the drying process becomes more efficient.

The invention claimed is:

1. A method of printing fluid on a substrate comprising:

providing drops of the fluid on the substrate by a print head, the fluid including one of ink and a primer; and spreading the drops of the fluid provided to the substrate to increase a surface area of the substrate covered by the drops of the fluid by at least one of application of a gaseous flow to hit the drops of the fluid provided to the substrate and movement of a squeegee across and to contact the drops of the fluid provided to the substrate.

2. The method of claim 1, wherein the substrate is generally planar and the drops of the fluid provided to the substrate are spread by applying a force with a component parallel to a plane of the substrate.

3. The method of claim 2, wherein the drops of the fluid provided to the substrate are spread immediately after the drops of the fluid have been placed on the substrate.

4. The method of claim 2, wherein the application of the gaseous flow comprises applying a stream of gas at an angle of 0° to 90° relative to the plane of the substrate at the position of and to contact and spread the drops of the fluid on the substrate.

5. The method of claim 2, further comprising predicting how the drops of the fluid will spread on the substrate prior to the spreading of the drops of the fluid provided on the substrate and spreading the drops of the fluid provided on the substrate accordingly to achieve a desired spreading result.

6. An inkjet printer for printing fluid on a substrate, comprising:

a print head for printing drops of the fluid on the substrate, the fluid including one of ink and a primer; and a spreader for spreading the drops of the fluid provided on the substrate thereon to increase a surface area of the substrate covered by the drops of the fluid on the substrate, wherein the spreader includes an air knife to hit the drops of the fluid provided on the substrate or a squeegee to contact the drops of the fluid provided on the substrate.

7. The inkjet printer of claim 6, further comprising a dryer arranged to dry the drops of the fluid provided on the substrate after the drops of the fluid provided on the substrate has been spread.

8. The inkjet printer of claim 6, wherein the spreader includes the squeegee to contact the drops of the fluid provided on the substrate such that the squeegee includes at least one of a non-wetting brush and a solid, continuous blade-type wiper.

9. An inkjet printer, comprising:

a print head to print drops of fluid on a substrate; and a squeegee to contact and spread the drops of the fluid provided on the substrate thereon to increase a surface area of the substrate covered by the drops of the fluid on the substrate; and wherein the squeegee includes at least one of a non-wetting brush and a solid, continuous blade-type wiper.

* * * * *